United States Patent [19]

Papa

[11] 4,188,599

[45] Feb. 12, 1980

[54] INDUCTANCE COIL FOR TELECOMMUNICATION SYSTEM AND METHOD OF MAKING SAME

[75] Inventor: Franco Papa, Cusano Milanino, Italy

[73] Assignee: Società Italiana Telecomunicazioni Siemens S.p.A., Milan, Italy

[21] Appl. No.: 860,836

[22] Filed: Dec. 15, 1977

[30] Foreign Application Priority Data

Dec. 17, 1976 [IT] Italy ..... 30517 A/76

[51] Int. Cl.[2] ..... H01P 7/00; H01F 15/10; H01F 27/78

[52] U.S. Cl. ..... 333/219; 29/605; 333/222; 336/192; 336/223

[58] Field of Search ..... 336/223, 222, 192; 29/605; 333/82 B, 82 R, 73 R, 73 W, 219, 222, 202, 208

[56] References Cited

U.S. PATENT DOCUMENTS

| | | | |
|---|---|---|---|
| 848,676 | 4/1907 | Murgas | 336/223 X |
| 1,547,497 | 7/1925 | Hunter | 336/223 X |
| 2,314,865 | 3/1943 | Bierwirth | 336/223 X |
| 2,674,680 | 4/1954 | Caliri | 336/223 X |
| 3,826,967 | 7/1974 | Wilkinson et al. | 336/223 X |

*Primary Examiner*—Thomas J. Kozma
*Attorney, Agent, or Firm*—Karl F. Ross

[57] ABSTRACT

A conductive coil, designed to be used as an inductance in a resonant cavity, comprises a metal strip integrally cut or etched from a sheet with a branch diverging from the main stem of the strip in the vicinity of one extremity thereof bent at an obtuse angle, that extremity ending in an enlarged terminal tab serving as a ground connection. After formation of the strip, the terminal tab is bent at right angles to the extremity whereas a major strip portion is helically wound about an axis in line with the center of the terminal tab.

8 Claims, 3 Drawing Figures

INDUCTANCE COIL FOR TELECOMMUNICATION SYSTEM AND METHOD OF MAKING SAME

FIELD OF THE INVENTION

My present invention relates to a conductive coil to be used as an inductance in a filter network or the like.

BACKGROUND OF THE INVENTION

In commonly owned application Ser. No. 860,835, filed Dec. 15, 1977 by Guiliano Brambilla, there has been disclosed and claimed a filter for a telecommunication system, designed particularly for frequencies in the microwave range, wherein such a coil is disposed inside a resonant cavity and has an intermediate tap by which one of its turns is connected to an input lead. One of the two ends of the coil is left unconnected while its opposite end is grounded at an adjoining cavity wall. The coil body is wound on a hollow core of low-loss dielectric material whose interior is partly occupied by a metal rod designed as a screw which may be axially shifted to vary a distributed capacitance existing between that rod and the portion of the coil lying between the free end and its tap. A lumped capacitor, also adjustable, is connected between the input lead and ground.

If the coil is wound from an ordinary round wire, the joining of the input lead to one of its turns by the usual soft-soldering method (using tin) creates difficulties since the heating of the wire may affect other connections within the cavity, such as the solder joint securing the grounded end of the coil to the cavity wall. Recourse is therefore frequently had to electric spot or seam welding which, however, cannot be easily performed with the required degree of precission as concerns the location of the tap along the coil; as is known, even a small change in that location may materially alter the electrical characteristics of the filter. Furthermore, the grounding of a coil terminal through a solder joint introduces a significant series resistance tending to lower the Q-value of the circuit.

OBJECT OF THE INVENTION

The object of my present invention, therefore, is to provide an inductance coil for the purpose described which obviates the aforestated drawbacks.

SUMMARY OF THE INVENTION

An inductance coil according to my invention has a multiturn helical body consisting of a flat metal strip wound about an axis parallel to its broad faces and terminating in a free end. The opposite end of the strip is unitary (i.e. made in one-piece) with an enlarged terminal tab lying substantially perpendicular to the body axis while a branch lead unitary with the strip extends from one of the turns of the body, preferably the last turn closest to the terminal tab.

The helical coil body may be separated from the terminal tab by an axially extending extremity of the strip constituting a supplemental inductance as discussed in the above-identified Brambilla application.

In producing such a coil, a flat metal strip of suitable length is formed integral with its terminal tab and its branch lead, e.g. by stamping or etching from a copper sheet. A major portion of the main stem of the strip (including its junction with the branch lead) is helically wound to form the coil whereas the terminal tab is bent approximately at right angles to an adjoining part of the stem so as to be substantially perpendicular to the coil axis which preferably is in line with the center of the tab. Since it is usually desired to let the branch lead lie in a plane transverse to the axis (or, more precisely, to make this axis perpendicular to the longitudinal plane of symmetry of that lead), the pitch angle of the coil will be substantially equal to the angle of divergence of the branch lead from the main stem of the strip prior to coiling. If the stem is to be linked with the terminal tab via an axially extending strip extremity as noted above, that extremity originally includes with the stem an obtuse angle differing from 90° by what is to become the pitch angle of the coil.

BRIEF DESCRIPTION OF THE DRAWING

The above and other features of my invention will now be described in detail with reference to the accompanying drawing in which.

SPECIFIC DESCRIPTION

Figure 1:
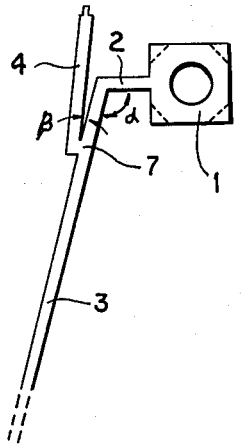
FIG. 1 is a plan view of a metal strip used in forming an inductance coil according to my invention.

In FIG. 1 I have shown a flat metal strip, cut or etched from a larger sheet, which has a main stem 3 and an angularly adjoining extremity 2 merging integrally into a terminal tab 1 of square outline. Extremity 2 includes with stem 3 an obtuse angle $\alpha$ while a branch lead 4, of substantially the same width as the stem, diverges therefrom at an angle $\beta \approx \alpha - 90°$.

Figure 2:
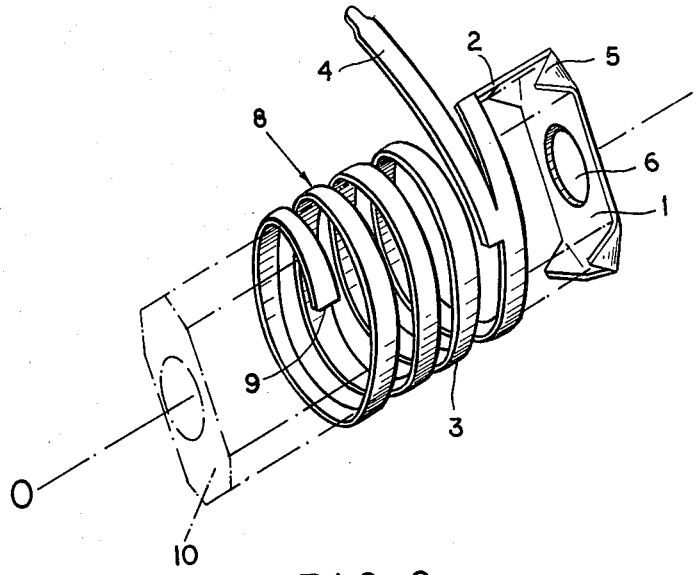
FIG. 2 is a perspective view of the completed coil.

As shown in FIG. 2, the major part of stem 3 is helically wound about an axis 0 paralleling the broad inner and outer strip faces to form a coil 8 with a free end 9, the branch lead 4 extending in a transverse plane from the final turn of the coil as seen from its terminal 9. Beyond its junction with lead 4, stem 3 is bent axially into an extremity 2 approximately in line with a generatrix of coil body 8. That extremity, in turn, is perpendicular to the terminal tab 1 which now is centered on axis 0. The tab 1 has a central port 6 forming a seat for a fastener as described hereinafter with reference to FIG. 3.

The four corners of tab 1 are axially inbent toward coil 8 so as to form a set of lugs 5 and to give the tab an octagonal contour matching that of a tubular dielectric core 10 on which the coil 8 is wound, the end of the core being thus embraceable by the tab.

Figure 3:
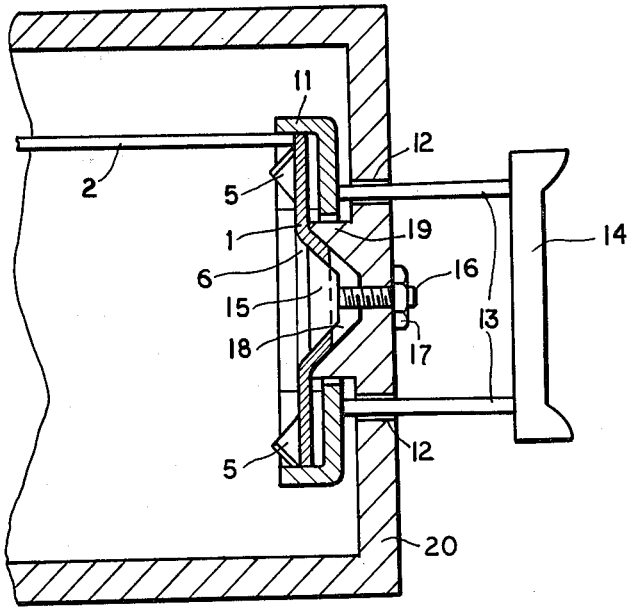
FIG. 3 is a cross-sectional view of part of a resonant cavity having the coil of FIG. 2 emplaced therein.

In FIG. 3 I have shown part of a resonant cavity 20 enclosing the coil of FIG. 2 of which only the strip extremity 2 with its terminal tab 1 is seen in this Figure; the peripheral cavity wall has an opening giving passage to branch lead 4, also not shown in FIG. 3, as illustrated in the aforementioned Brambilla application. A holder or key 11 of octagonal outline matingly receives the tab 1 and surrounds a neck 19 of an end wall of cavity 20 which is formed with arcuate slits 12 traversed by pins 13 serving to connect the key 11 to an external handle 14. Port 6 rests against a frustoconical aperture 18 of the cavity wall and surrounds a tapering head 15 of a screw 16 engaged by an external nut 17; thus, tab 1 is held in close conductive contact with the grounded cavity wall. Key 11 is rotatable by means of handle 14, within the limits of slits 12, to adjust the angular position of the coil and the effective length of branch lead 4 within the cavity. With the core 10 (FIG. 2) properly anchored to the opposite cavity wall, the coil is held in a stable position.

I claim:

1. An inductance coil for high-frequency filtering, comprising:

a helical body with several turns consisting of a flat metal strip with broad faces wound about an axis parallel to said broad faces, said strip terminating in a free end;

an enlarged terminal tab of one piece construction with said strip adjoining said body opposite said free end and lying substantially perpendicular to and centered on said axis; and a branch lead of one piece construction with said strip extending at an acute angle from one of said turns.

2. A coil as defined in claim 1 wherein said branch lead has a plane of symmetry substantially transverse to said axis.

3. A coil as defined in claim 1 wherein said strip has an axially extending extremity separating said terminal tab from the last turn of said body.

4. A coil as defined in claim 3 wherein said branch lead extends from said last turn.

5. A coil as defined in claim 1 wherein said terminal tab is of polygonal outline.

6. A coil as defined in claim 5 wherein said terminal tab has corners axially inbent toward said body.

7. A coil as defined in claim 5 wherein said terminal tab is provided with a round seat in line with said axis.

8. In combination, an inductance coil as defined in claim 1 and a resonant cavity coaxially surrounding said coil, said branch lead extending outwardly through an opening of said cavity.

* * * * *